US012256804B2

(12) United States Patent
Champagne et al.

(10) Patent No.: US 12,256,804 B2
(45) Date of Patent: Mar. 25, 2025

(54) SKATE WITH TOE CAP EXTENSION

(71) Applicant: SPORT MASKA INC., Montreal (CA)

(72) Inventors: Etienne Champagne, Saint-Joseph-de-Beauce (CA); Alexis Faucher, Laval (CA); Samuel Maheux, Laval (CA); Philippe Lapierre, Montréal (CA)

(73) Assignee: SPORT MASKA INC., St-Laurent (CA)

( * ) Notice: Subject to any disclaimer, the term of this patent is extended or adjusted under 35 U.S.C. 154(b) by 0 days.

(21) Appl. No.: 18/031,811

(22) PCT Filed: Oct. 15, 2021

(86) PCT No.: PCT/CA2021/051447
§ 371 (c)(1),
(2) Date: Apr. 13, 2023

(87) PCT Pub. No.: WO2022/077114
PCT Pub. Date: Apr. 21, 2022

(65) Prior Publication Data

US 2023/0389647 A1 Dec. 7, 2023

Related U.S. Application Data

(60) Provisional application No. 63/092,597, filed on Oct. 16, 2020.

(51) Int. Cl.
*A43B 5/16* (2006.01)
*A43B 23/08* (2006.01)

(52) U.S. Cl.
CPC ..... *A43B 5/16* (2013.01); *A43B 23/081* (2013.01)

(58) Field of Classification Search
CPC ..... A43B 5/16; A43B 23/081; A43B 7/32
See application file for complete search history.

(56) References Cited

U.S. PATENT DOCUMENTS 4,342,159 A * 8/1982 Edwards ..... A43C 13/14 36/77 R
D654,260 S * 2/2012 Frappier ..... D2/904
(Continued)

FOREIGN PATENT DOCUMENTS

CN 108577024 9/2018
CN 108577024 A * 9/2018 ..... A43B 5/16

OTHER PUBLICATIONS

CN-108577024 English Translation (Year: 2018).*

*Primary Examiner* — Ted Kavanaugh
(74) *Attorney, Agent, or Firm* — NORTON ROSE FULBRIGHT CANADA

(57) ABSTRACT

A skate includes a skate boot with two opposed boot side portions extending from heel and ankle portions to a forward edge of the boot side portions. A forward-most eyelet is the eyelet closest to the forward edge. A toe cap is connected to the skate boot at a front end, and the toe cap has toe cap side portions extending rearwardly to a rear edge of the toe cap disposed forward of the forward-most eyelet. A toe cap extension extends rearwardly from the rear edge of the toe cap and over a portion of the boot side portions defined rearward of the forward edge and below the forward-most eyelet. The toe cap extension engages the portion of the skate boot and allows movement of at least the skate boot rearward of the forward-most eyelet during formation of the skate boot or use thereof.

20 Claims, 9 Drawing Sheets

(56) References Cited

U.S. PATENT DOCUMENTS

| | | | | |
|---|---|---|---|---|
| 2012/0011742 | A1* | 1/2012 | Yang | A43B 23/081 36/77 R |
| 2019/0191816 | A1 | 6/2019 | Seguin et al. | |

* cited by examiner

SKATE WITH TOE CAP EXTENSION

CROSS-REFERENCE TO RELATED APPLICATIONS

This application is a United States Patent Application filed under 35 U.S.C. 371 of International Patent Application No. PCT/CA2021/051447 filed Oct. 15, 2021, which claims priority on U.S. Patent Application No. 63/092,597 filed Oct. 16, 2020, the entire disclosure of both of which are incorporated by reference herein.

TECHNICAL FIELD

The application relates generally to skates and, more particularly, to skates with toe caps.

BACKGROUND

Typical hockey skates have a toecap at the forefront to protect the toes, and to some extent the side of the foot, of the wearer from the various outside forces that can be directed to the foot during hockey games. Such toecaps are typically much more robust and less flexible than the skate boot from which it extends. How far back such toecaps extend towards the heel, or how much the skate boot extends forward towards the toes, is an exercise in balancing the need to have the boot as comfortable/flexible as possible with the need to have the toecap protect the foot as much as possible. Furthermore, immediately downstream of the boundary between the skate boot and the toecap is an area of potential weakness that is susceptible to damage from abrasion, cuts and the likes.

SUMMARY

There is disclosed a skate, comprising: a skate boot comprising a heel portion, an ankle portion connected to the heel portion, and two opposed boot side portions extending from the heel and ankle portions to a forward edge of the boot side portions, eyelets defined in each of the boot side portions, a forward-most eyelet being the eyelet closest to the forward edge of the boot side portions; a toe cap connected to the skate boot at a front end thereof, the toe cap having an upper portion, a front portion, and toe cap side portions extending rearwardly to a rear edge of the toe cap, the rear edge of the toe cap being disposed forward of the forward-most eyelet; a toe cap extension extending rearwardly from the rear edge of the toe cap and over a portion of at least one of the boot side portions defined rearward of the forward edge and below the forward-most eyelet, the toe cap extension engaging the portion and allowing movement of at least the skate boot rearward of the forward-most eyelet during formation of the skate boot or use thereof; and a holder mounted under the skate boot and configured for retaining a ground-engaging skate element.

The skate may include one of more of the following features, in whole or in part, and in any combination.

In some embodiments, the toe cap extension has a thickness less than a thickness of the toe cap to allow movement of at least the skate boot rearward of the forward-most eyelet during formation of the skate boot or use thereof.

In some embodiments, the toe cap extension is made of material that is more malleable than a material of the toe cap, to allow movement of at least the skate boot rearward of the forward-most eyelet during formation of the skate boot or use thereof.

In some embodiments, the toe cap extension has a thickness less than a thickness of the toe cap and the toe cap extension is made of material that is more malleable than a material of the toe cap, to allow movement of at least the skate boot rearward of the forward-most eyelet during formation of the skate boot or use thereof.

In some embodiments, the portion of the at least one boot side portion extends upwardly from a sole portion the skate boot to immediately beneath the forward-most eyelet, the toe cap extension extending upwards to cover the portion.

In some embodiments, the skate comprises an eyelet protector over at least one of the boot side portions and disposed around the forward-most eyelet, the eyelet protector extending downwardly over at least some of the portion of the at least one boot side portion.

In some embodiments, the eyelet protector extends downwardly over the portion from the forward-most eyelet, and the toe cap extension extends upwardly over the portion and abuts against the eyelet protector.

In some embodiments, the toe cap extension has an upper portion extending rearwardly from the rear edge of the toe cap along a top portion of the skate boot to overlie a foot of the wearer or a tongue of the skate.

In some embodiments, the toe cap extension has an aft edge defined by a first segment of the aft edge extending upwardly from a sole portion of the skate boot toward the forward-most eyelet, a second segment extending from the first segment in a substantially forward direction toward the front portion of the toe cap, and a third segment extending from the second segment in an upward direction toward the upper portion of the toe cap, the first segment disposed rearward of the forward-most eyelet.

In some embodiments, the third segment is disposed in front of the forward-most eyelet.

In some embodiments, a thickness of the toe cap extension is constant.

In some embodiments, a thickness of the toe cap varies between the front portion and the rear edge.

In some embodiments, the toe cap has a thickness transition region adjacent to the rear edge, a thickness of the thickness transition region being equal to a thickness of the toe cap at a forward end of the thickness transition region, and the thickness of the thickness transition region being equal to a thickness of the toe cap extension at a rear end of the thickness transition region.

In some embodiments, the toe cap is made from a first material and the toe cap extension is made of a second material different from the first material, the toe cap adjacent to the rear edge thereof having an inner portion made of the first material and an outer portion made of the second material and overlying the inner portion.

In some embodiments, a forward-most edge of the toe cap extension is coterminous with the rear edge of the toe cap and defines a boundary, the boundary disposed in front of the forward-most eyelet.

In some embodiments, the boundary is free of stitching.

In some embodiments, a part of the forward edge of the boot side portion is aft of the rear edge of the toe cap.

In some embodiments, the toe cap is made from a first material having a first hardness, and the toe cap extension is made from a second material having a second hardness being less than the first hardness.

In some embodiments, the toe cap extension is integral with the toe cap.

In some embodiments, the toe cap extension is separate from the toe cap and secured to one or both of the toe cap and the boot side portion.

In some embodiments, the toe cap extension is a first toe cap extension extending rearwardly from the rear edge of the toe cap and over the portion of one of the boot side portions, the skate comprising a second toe cap extension extending rearwardly from the rear edge of the toe cap and over the portion of the other boot side portion.

In some embodiments, the first and second toe cap extensions are positioned symmetrically about a longitudinal axis of the skate.

In some embodiments, the toe cap extension has an axial extent along a longitudinal axis of the skate from the rear edge of the toe cap to an axial position aft of the forward-most eyelet and between another eyelet adjacent the forward-most eyelet.

BRIEF DESCRIPTION OF THE DRAWINGS

Reference is now made to the accompanying figures in which.

DETAILED DESCRIPTION

Figure 1A:
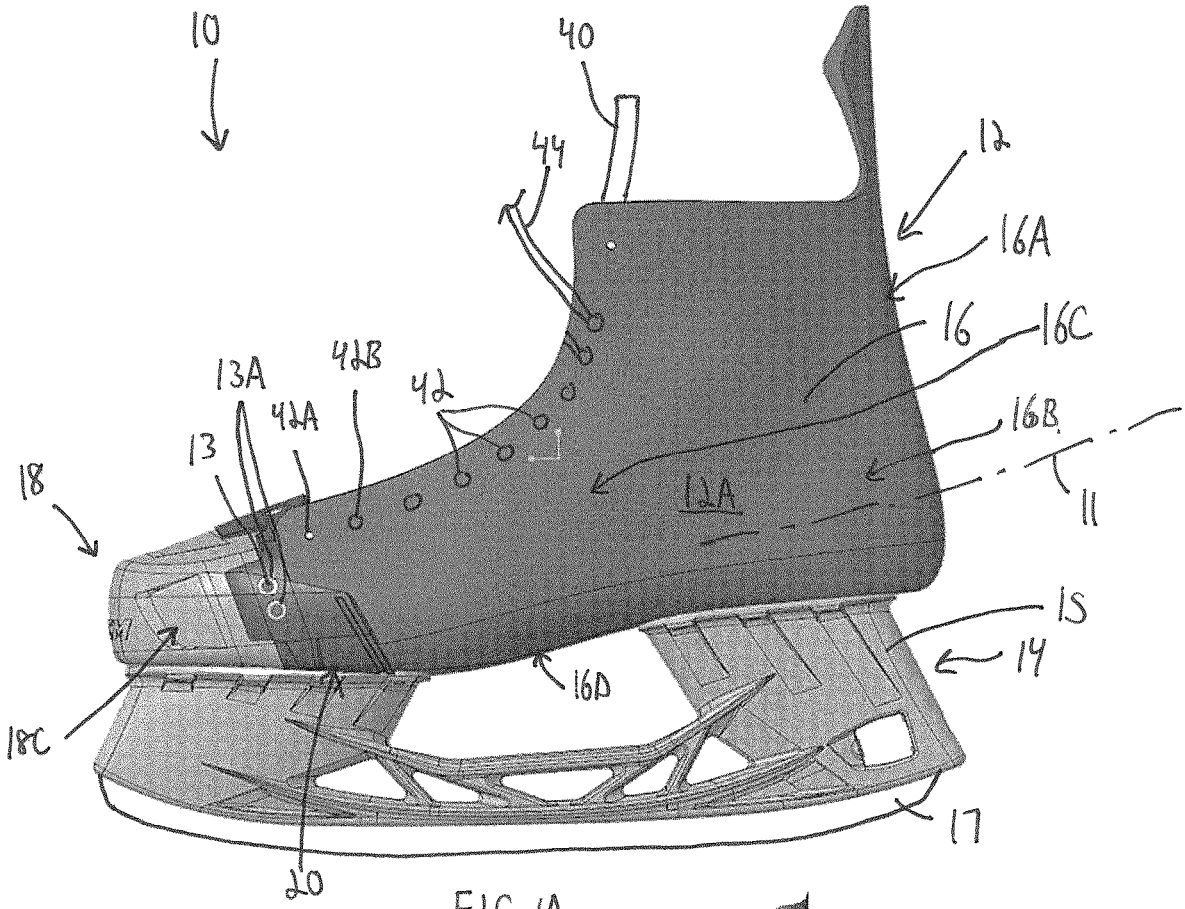
FIG. 1A is a schematic side elevational view of a skate with a toe cap extension.

Referring to FIG. 1A, a skate 10 is generally shown. The skate 10 includes a skate boot 12 and a ground-engaging assembly 14 including a holder 15 and a ground-engaging element 17, which is shown as a blade. It is understood that the particular skate configuration shown here is provided as an example only and that alternate configurations are possible, including, but not limited to, other types of ground engaging assemblies such as roller skate ground engaging assemblies where the ground engaging elements include rollers or wheels. The skate boot 12 has an outer surface 12A and includes a boot shell 16, and the skate 10 includes a toe cap 18, which in the embodiment shown is engaged to the boot shell 16. The toe cap 18 may be made from a hard or stiff material to protect the toes of the wearer. The boot shell 16 generally includes a heel portion 16A, an ankle portion 16B connected to the heel portion 16A, two opposed boot side portions 16C extending from the heel and ankle portions 16A,16B, and a sole portion 16D connected to the heel, ankle and boot side portions 16A,16B,16C. The sole portion 16D is connected to the ground-engaging assembly 14, and is shaped to receive the foot of the wearer thereon, in a particular embodiment with an inner liner and/or insole extending between the sole portion 16D and the foot.

The spaced apart boot side portions 16C (sometimes referred to herein simply as "side portions 16C") define quarters and an instep portion of the boot shell 16, and cooperate together to surround the foot of the wearer. Eyelets 42 are defined in each of the side portions 16C, along an upper end thereof. The eyelets 42 are formed by holes defined through the side portions 16C and bordered by a suitable reinforcement ring (e.g. metal or plastic). The eyelets 42 may be arranged in a row. The eyelets 42 are configured to receive a lace 44 therethrough. The lace 44 is threaded through the eyelets 42 across the side portions 16C for fastening the side portions 16C closer together thereby securing the boot shell 16 onto the foot. In the embodiment shown, the eyelets 42 have a circular shape. However, the eyelets 42 can have any other appropriate configuration, shape and/or size. A forward-most eyelet 42A is the eyelet 42 that is closest to the toe cap 18. The forward-most eyelet 42A is the eyelet 42 that is closest to the front of the skate 10. A second eyelet 42B is the eyelet 42 immediately adjacent the forward-most eyelet 42A in a direction toward the heel portion 16A.

Referring to FIG. 1A, the skate 10 includes a tongue 40 extending between the side portions 16C. When the foot is properly placed inside the boot shell 16, the tongue 40 can cover a substantial part of an instep region of the foot. The skate 10 may include any other suitable features or components, such as for example an inner liner received inside the boot shell 16, a facing along the side edges, etc.

Figure 1B:
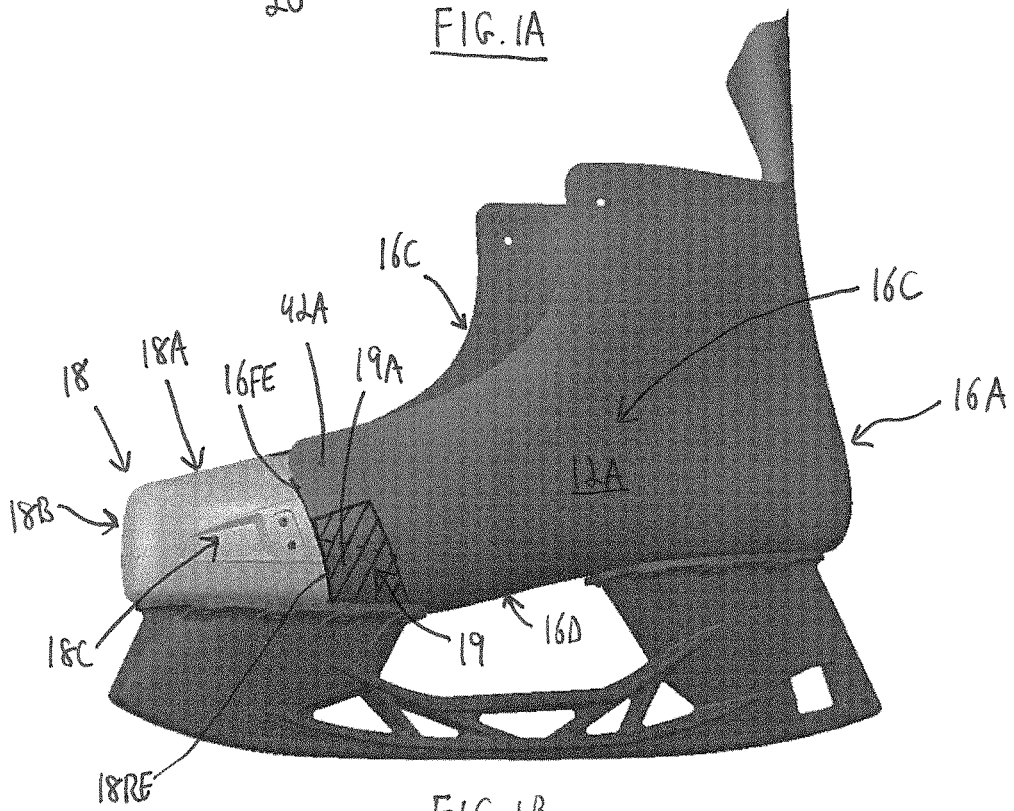
FIG. 1B is a schematic tridimensional view of the skate of FIG. 1A shown without the toe cap extension.

The toe cap 18 is engaged to a front end of the skate boot 12. Referring to FIGS. 1A and 1B, the toe cap 18 is engaged to front ends of the opposed side portions 16C and of the sole portion 16D. The front end of the side portions 16C has a forward edge 16FE. In FIGS. 1A and 1B, the forward edge 16FE is the forward-most portion of the side portions 16C. Referring to FIGS. 1A and 1B, the forward edge 16FE is the feature of the side portions 16C that is located closest to the toe cap 18. The forward edge 16FE may be curved, straight, or made up of different angled segments. The toe cap 18 may be connected to the front ends of the side portions 16C by fasteners, such as rivets 13 inserted through holes 13A in the toe cap 18, but any other suitable technique for joining the toe cap 18 to the skate boot 12 may be used. For example, and as described below in greater detail, the toe cap 18 may be further connected to the side portions 16C via another component of the skate 10—a toe cap extension 20. The toe cap 18 has an upper portion 18A to protect the top of the toes, and a front end portion 18B to protect the front of the toes. The toe cap 18 has toe cap side portions 18C extending from the upper and front end portions 18A,18B to protect the side of the toes. The toe cap side portion 18C shown in FIGS. 1A and 1B extends rearwardly toward the heel portion 16C. The toe cap side portion 18C shown in FIGS. 1A and 1B extends rearwardly from the front end portion 18B to a rear edge 18RE of the toe cap 18 that is located adjacent to the forward-most eyelet 42A. The rear edge 18RE of the toe cap 18 is located closer to the front end portion 18B than the forward-most eyelet 42A.

Referring to FIG. 1B, an upper part of the forward edge 16FE of the side portion 16C is positioned immediately aft of the rear edge 18RE of the toe cap 18. A small gap may be defined between this upper part of the forward edge 16FE of the side portion 16C and the rear edge 18RE of the toe cap 18. In an embodiment, the forward edge 16FE of the side portion 16C and the rear edge 18RE of the toe cap 18 are coterminous. Other configurations for the relationship between the side portion 16C and the toe cap 18 are possible. For example, in FIGS. 1A and 1B, the toe cap 18, and more particularly the toe cap side portions 18C, overlaps a portion of the side portion 16C including the remainder of the forward edge 16FE. Part of a forward end of the side portion 16C, including part of the forward edge 16FE, is overlapped by the toe cap 18.

The opposed side portions 16C cover medial and lateral sides of the foot of the wearer. The side portions 16C have an axial extent defined along a longitudinal axis 11 of the skate boot 12. The axial extent for the side portions 16C is from the heel and/or ankle portions 16A,16B to the forward edge 16FE of the side portions 16C.

Referring to FIG. 1B, the outer surface 12A of the skate boot 12 along one or both of the side portions 16C has an area prone to abrasion 19. The area prone to abrasion 19 is a surface or segment of the outer surface 12A of one or both of the side portions 16C that is likely to suffer wear and damage during use of the skate 10 by the wearer. The area prone to abrasion 19 is an area of the side portions 16C aft or rearward of the toe cap side portion 18C, and rearward of the rear edge 18RE. At this location on the side portion 16C, the area prone to abrasion 19 is susceptible to being nicked, scratched, cut or otherwise damaged because the harder material of the toe cap 18 is not present to protect the area prone to abrasion 19. The area prone to abrasion 19 is adjacent to the forward edge 16FE of one or both of the side portions 16C. The area prone to abrasion 19 has an extent defined rearwardly of the forward edge 16FE and is spaced closely rearward of the forward edge 16FE. The area prone to abrasion 19 is thus a portion of the skate boot 12 at the forefoot which is susceptible to abrasion.

To protect some or all of the area prone to abrasion 19, the skate 10 or the toe cap 18 has one or more toe cap extensions 20. The embodiment of the skate 10 shown in FIG. 1A has two toe cap extensions 20, only one of which is visible in the view provided. Each toe cap extension 20 extends from a corresponding one of the toe cap side portions 18C. Both toe cap extensions 20 in FIG. 1A are positioned symmetrically about the longitudinal axis 11 of the skate 10 and spaced equidistantly therefrom. Each toe cap extension 20 extends rearwardly toward the heel portion 16A of the skate boot 12, and is sized to be positioned over a corresponding one of the areas prone to abrasion 19 on the side portions 16C of the skate boot 12. The toe cap extensions 20 thus extend over, and cover, the areas prone to abrasion 19, to reduce or eliminate the damage they may suffer when the wearer uses the skate 10. Each toe cap extension 20 covers an overlapped area or portion 19A of the corresponding side portion 16C shown in FIG. 1B. The overlapped portion 19A is along the outer surface of the side portion 16C, and is a segment of the area prone to abrasion 19. In an embodiment, the overlapped portion 19A is the minimum surface area of the area prone to abrasion 19 that is needed to successfully bond or join the toe cap extension 20 to the side portion 16C. In FIGS. 1A and 1B, the overlapped portion 19A extends upwardly from the sole portion 16D to immediately beneath the forward-most eyelet 42A. The toe cap extension 20 extends upwards as well to cover the overlapped portion 19A.

Figure 1C:
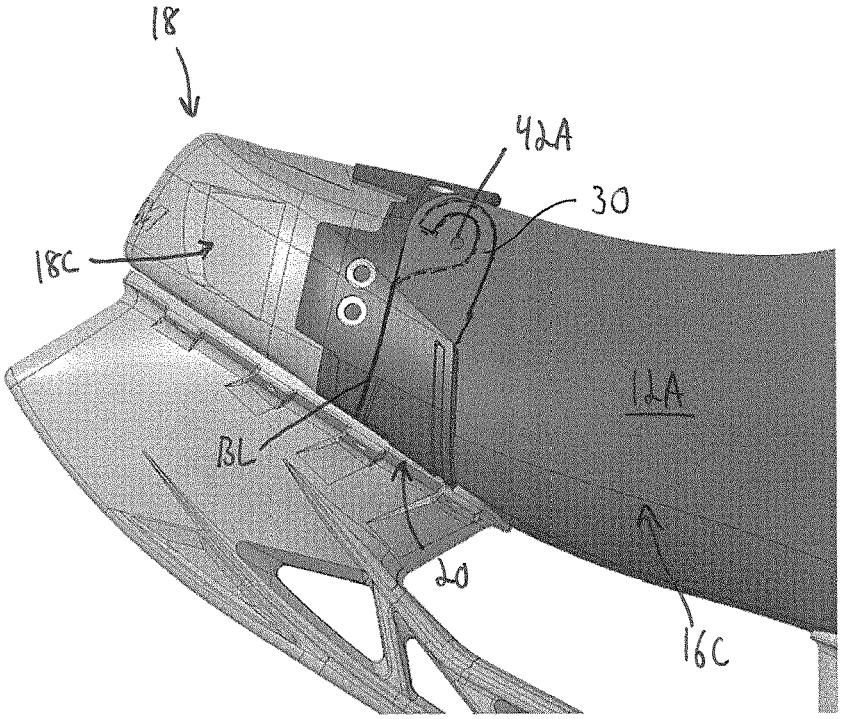
FIG. 1C is a schematic tridimensional view of a portion of the skate of FIG. 1A.
Figure 1D:
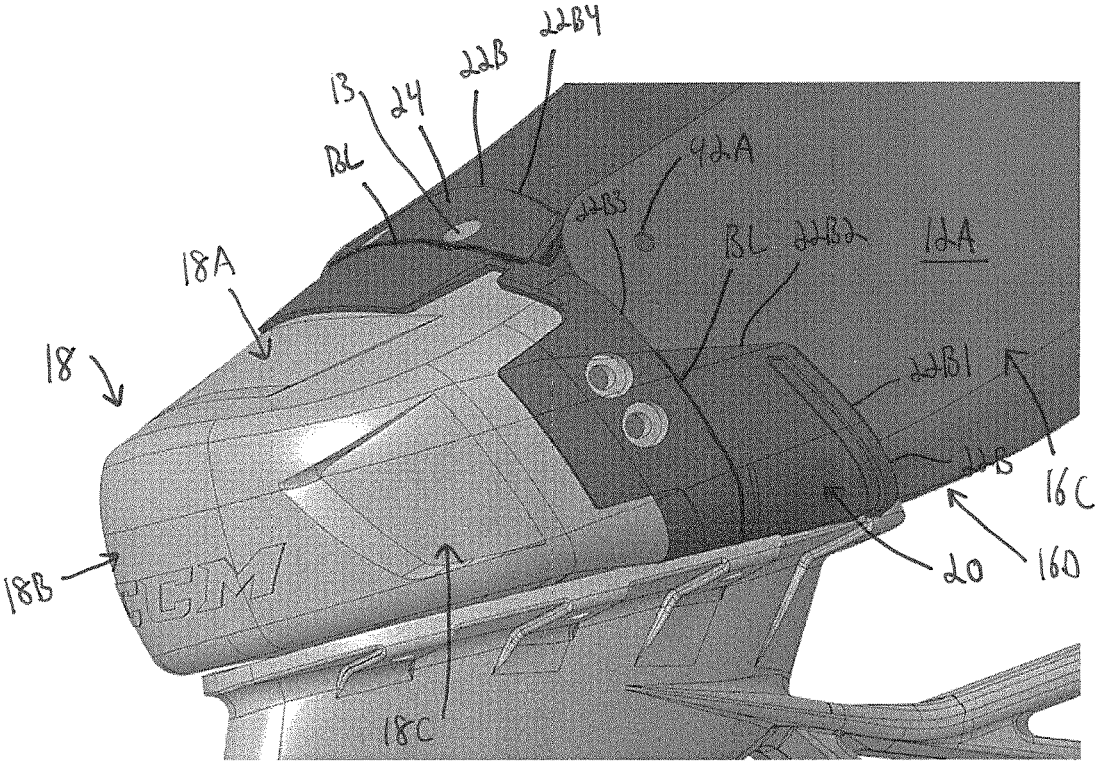
FIG. 1D is another schematic tridimensional view of a portion of the skate of FIG. 1A.

Referring to FIGS. 1C and 1D, the toe cap extension 20 is integral with the toe cap 18. In FIGS. 1C and 1D, the toe cap extension 20 and the toe cap 18 are a monolithic body. In FIGS. 1C and 1D, the toe cap extension 20 and the toe cap 18 are a single-body construction formed during a molding process. In FIGS. 1C and 1D, the toe cap extension 20 and the toe cap 18 are continuously integral along a junction line or boundary BL such that there are no gaps between the toe cap extension 20 and the toe cap 18 along the boundary BL. The boundary BL between the toe cap extension 20 and the toe cap 18 is stitch-less. The boundary BL between the toe cap extension 20 and the toe cap 18 is seamless. The boundary BL between the toe cap extension 20 and the toe cap 18 is solidly continuous integral. Joining the toe cap extension 20 and the toe cap 18 without stitches removes a potential weakness in the skate boot 12 that might be formed along the line of stitches. Although described herein as being integral with one another, the toe cap 18 and the toe cap extension 20 are distinguished herein as two different components for the purposes of describing the features of each, and are demarcated from each other by the boundary BL. It will be appreciated therefore that the boundary BL may not be a physical feature, but may instead be a geometric boundary between the toe cap 18 and the toe cap extension 20. In an alternate embodiment, the toe cap extension 20 is a separate component from the toe cap 18 and is attached thereto. In this alternate embodiment, the toe cap extension 20 may be glued to the toe cap side portions 18C. The toe cap extension 20 thus extends over a portion of the outer surface 12A of the skate boot 12 at the forefoot that is susceptible to abrasion. The toe cap extension 20 therefore protrudes outwardly from the outer surface 12A in the area prone to abrasion 19.

Irrespective of whether the toe cap extension 20 is integral or separate from the toe cap 18, the toe cap extensions 20 are secured to the side portions 16C of the skate boot 12 using any suitable technique. For example, and as shown in FIGS. 1C and 1D, the toe cap extensions 20 are bonded or adhered to the side portions 16C. In an alternate embodiment, the toe cap extension 20 is fastened with rivets to the side portions 16C of the skate boot 12. Other possible attachment techniques include, but are not limited to, bolting and welding. These techniques may be combined as desired. As shown in FIGS. 1C and 1D, the toe cap extension 20 is secured to the side portion 16C free of stitching. The attachment formed between the toe cap extension 20 and the side portion 16C is stitch-less. Joining the toe cap extension 20 and the side portion 16C without stitches removes a potential weakness in the skate boot 12 that might be formed along the line of stitches.

Figure 2A:
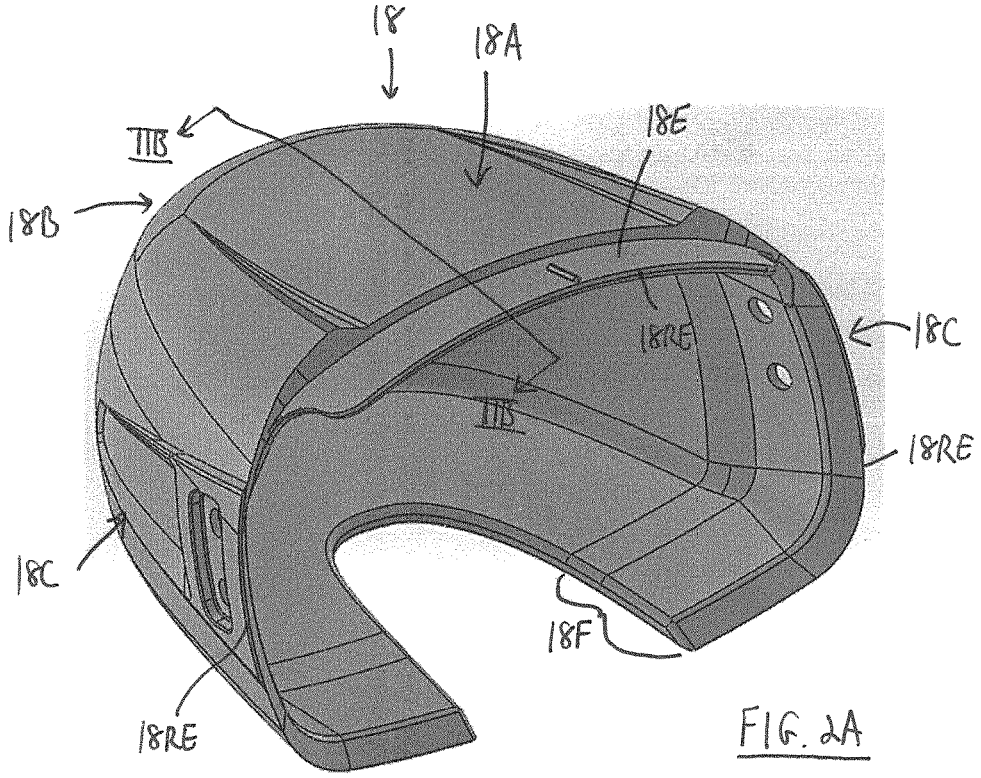
FIG. 2A is a schematic tridimensional view of a toe cap of the skate of FIG. 1A.
Figure 2B:
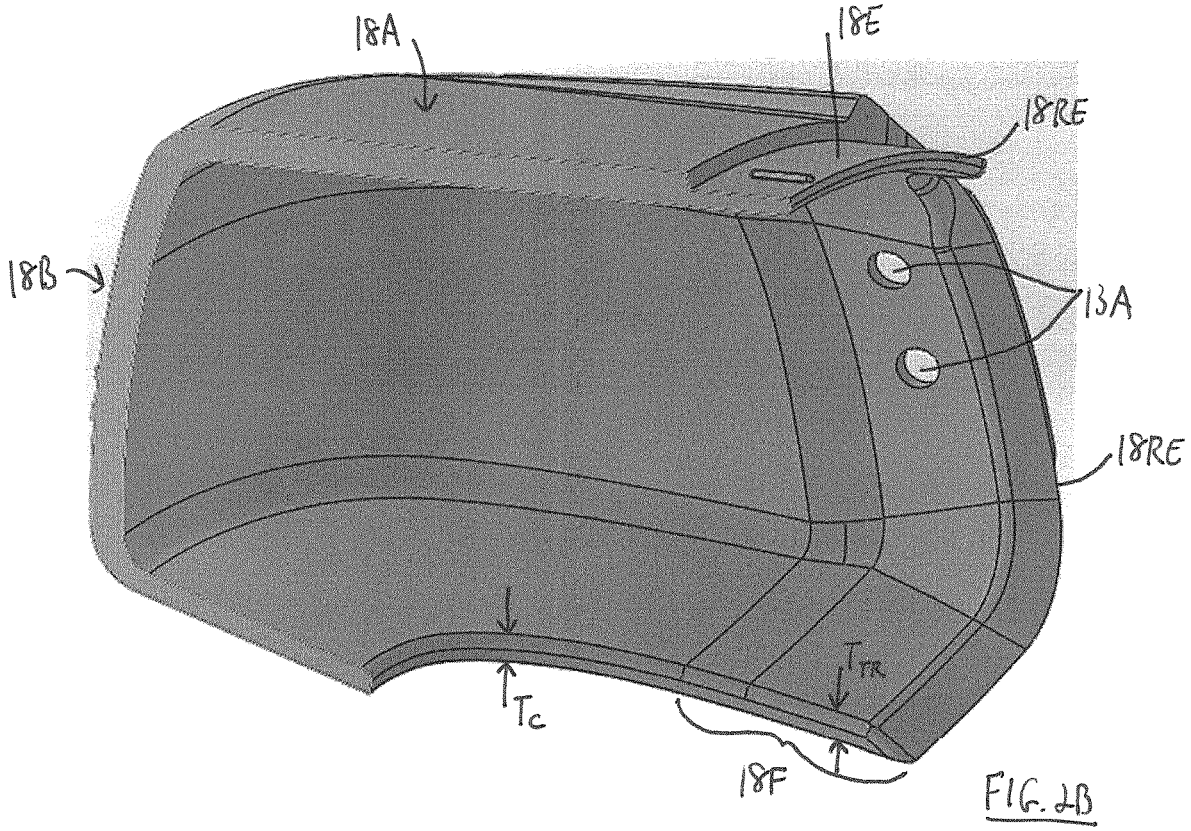
FIG. 2B is a cross-sectional view of the toe cap of FIG. 2A taken along the line IIB-IIB.
Figure 3A:
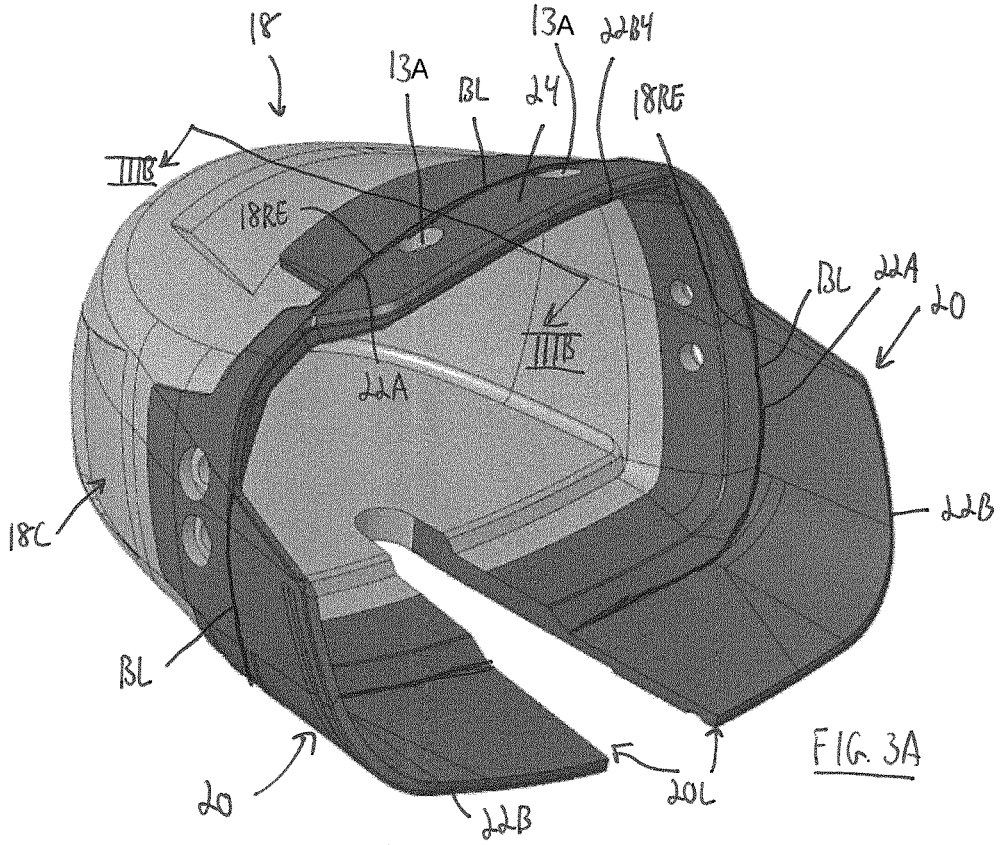
FIG. 3A is a schematic tridimensional view of the toe cap of FIG. 2A with the toe cap extension of the skate of FIG. 1A.
Figure 3B:
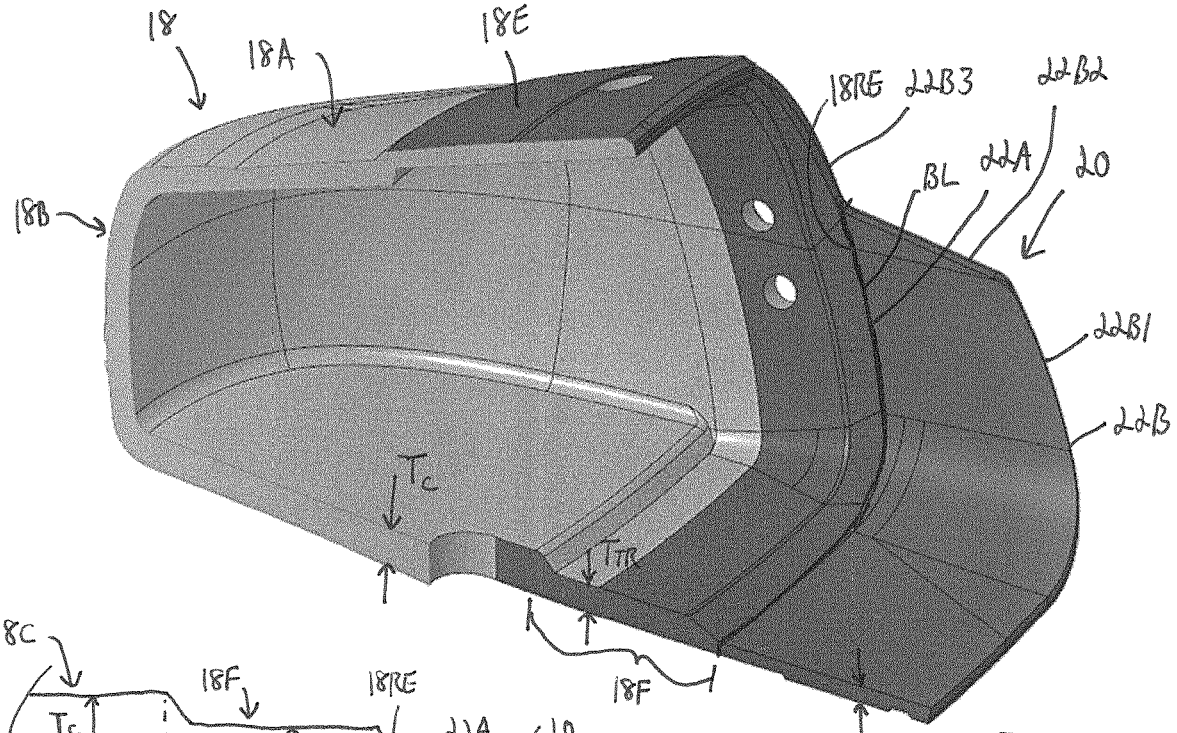
FIG. 3B is a cross-sectional view of the toe cap and toe cap extension of FIG. 3A taken along the line IIIB-IIIB.

FIGS. 2A and 2B show the toe cap 18 in isolation, and FIGS. 3A and 3B show the toe cap 18 and the toe cap extension 20. FIGS. 2A and 2B show the toe cap 18 with the upper portion 18A, the front end portion 18B, and the toe cap side portions 18C extending rearwardly from the front end portion 18B to the rear edge 18RE. Along the upper portion 18A of the toe cap 18, the rear edge 18RE is defined along an inner portion or flap 18E of the toe cap 18. The flap 18E extends rearwardly from a remainder of the upper portion 18A and is thinner than the remainder of the upper portion 18A. Forward of the rear edge 18RE of the toe cap 18, there is a thickness transition region 18F of the top cap 18, in which the thickness $T_{TR}$ varies over the length of the thickness transition region 18F. In a direction forward of the thickness transition region 18F, the toe cap 18 has a substantially constant thickness $T_C$. At a forward-most end of the thickness transition region 18F, the thickness $T_{TR}$ is equal to the thickness $T_C$ of the toe cap 18. The holes 13A for the rivets 13 are located in the thickness transition region 18F. The thickness transition region 18F tapers or thins over its length in a rearward direction to match the thickness of the toe cap extension 20, as explained in greater detail below.

Referring to FIGS. 3A and 3B, the toe cap extensions 20 joined to the side portions 16C have a lengthwise extent in a direction parallel to longitudinal axis 11. The lengthwise extent is defined between a forward edge 22A of the top cap extension 20 and an aft edge 22B of the toe cap extension 20. The aft edge 22B is closer to the heel portion 16C than the forward edge 22A. The forward edge 22A of the toe cap extension 20 is coterminous with part of the rear edge 18RE of the toe cap side portion 18C. Referring to FIGS. 1D and 3A, the aft edge 22B of the toe cap extension 20 is defined by segments that are angled with respect to each other. In FIGS. 1D and 3A, a first segment 22B1 of the aft edge 22B extends from the sole portion 16D in an upward direction toward the forward-most eyelet 42A. A second segment 22B2 of the aft edge 22B extends from the upper end of the first segment 22B1 in a substantially forward direction toward the front end portion 18B of the toe cap 18. A third segment 22B3 of the aft edge 22B extends from the forward-most end of the second segment 22B2 in an upward direction toward the upper portion 18A of the toe cap 18. In FIG. 1D, the first segment 22B1 is disposed aft or rearward of the forward-most eyelet 42A. The third segment 22B3 is disposed in front of the forward-most eyelet 42A. Other configurations for the aft edge 22B of the toe cap extension 20 are possible. Referring to FIG. 3A, a lower portion 20L of the toe cap extension 20 abuts against, and may be joined to, the sole portion 16D of the boot shell 16.

In FIGS. 3A and 3B, the boundary BL between the toe cap 18 and the toe cap extension 20 is defined along the coterminous forward edge 22A of the toe cap extension 20 and the rear edge 18RE of the toe cap side portion 18C. The boundary BL is forward of the forward-most eyelet 42A (see FIG. 1D). Having the boundary BL in this location may help to ensure that the skate boot 12 retains its thermoformability in a rearward direction from the forward-most eyelet 42A. In contrast, some conventional toecaps which extend downstream of the forward-most eyelets may negatively impact the thermoformability of the skate boot at locations rearward of the forward-most eyelets.

The skate boot 12 with the toe cap extension 20 disclosed herein is therefore free to move or expand at locations along the skate boot 12 that are rearward of the forward-most eyelet 42A, because the relatively large and rigid toe cap 18 is maintained forward of the forward-most eyelet 42A with only a smaller and often more pliable toe cap extension 20 extending adjacent to, or rearward of, the forward-most eyelet 42A. The toe cap extension 20 therefore does not impede the movement of the skate boot 12 rearward of the forward-most eyelet 42A, for example during the thermo moulding/forming process of the skate boot 12. In such a process, a mold is applied to a pre-form of the skate 10, which may include pre-forms of the skate boot 12, the toe cap 18, and the toe cap extension 20. Heat and pressure are applied to the mold, and this may cause the thermal deformation of the skate boot 12. The free movement of the skate boot 12 may allow for better molding of the skate boot 12 while it is being worn on the foot of the wearer. In such a process, the wearer places the pre-form of the skate boot 12, the toe cap 18, and the toe cap extension 20 onto their foot. A mold is placed around the pre-form on the foot, and heat and pressure is applied to cause the thermal deformation of the skate boot 12. For some conventional skate boots, extending the toecap itself rearwards from the forward most eyelets may hinder the thermoformability of the skate boot because the skate boot, particularly around the forefront where the rigid and extended toe cap is present, cannot be thermoformed to a wearer's foot and/or feels too rigid or inflexible at the location of the extended toe cap. Different properties of the toe cap extension 20 may contribute to its facilitating of movement of the skate boot 12 rearward of the forward-most eyelet 42A, during both thermoformation of the skate boot 12 and its use by the wearer. Some of these properties are described in greater detail below.

Figure 3C:
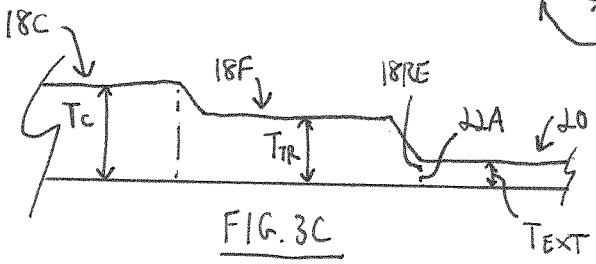
FIG. 3C is a schematic view showing the thicknesses of the toe cap and the toe cap extension.

One of these properties of the toe cap extension 20 is its thickness. Referring to FIGS. 3A and 3B, a thickness T EXT of the toe cap extension 20 is constant between the forward and aft edges 22A,22B. The thickness $T_{EXT}$ of the toe cap extension 20 is uniform between the forward and aft edges 22A,22B. Referring to FIG. 3B, the thickness of the toe cap 18 varies along the toe cap side portion 18C, for example, along the thickness transition region 18F in which the thickness $T_{TR}$ varies over the length of the thickness transition region 18F. In a direction forward of the thickness transition region 18F, the toe cap 18 has a substantially constant thickness $T_C$. At a forwardmost end of the thickness transition region 18F, the thickness $T_{TR}$ is equal to the thickness $T_C$ of the toe cap 18. At a rearmost end of the thickness transition region 18F, the thickness $T_{TR}$ is equal to the thickness $T_{EXT}$ of the toe cap extension 20. The thinner toe cap extension 20 is positioned over the area prone to abrasion 19, and since it is thinner than the remainder of the toe cap 18, it is more easily thermo-deformable and less likely to restrict movement of the skate boot 12 aft of the forward-most eyelet 42A. The relationship between the various thicknesses $T_C$, $T_{TR}$, $T_{EXT}$ of the toe cap 18, the thickness transition region 18F and the toe cap extension 20 are shown schematically in FIG. 3C.

Another one of the properties of the toe cap extension 20 that may contribute to its facilitating of movement of the skate boot 12 rearward of the forward-most eyelet 42A is the material of the toe cap extension 20. The toe cap extension 20 may be made of material that is more malleable than the material of the toe cap 18. The toe cap extension 20 in an embodiment is thermoformable. Part of the toe cap 18 itself, such as the thickness transition region 18F, may also be made of the more malleable or softer material from which the toe cap extension 20 is made. In an embodiment, the toe cap 18 is made of nylon. Other possible materials for the toe cap 18 include, but are not limited to, Surlyn™, HDPE, PE, Pebax™, Hyrtel™, TPU, TPE, ABS, PP, PVC, Aluminum, Magnesium, and Epoxy. In an embodiment, the toe cap extension 20 is made of TPU. Other possible materials for the toe cap extension 20 include, but are not limited to, Surlyn™, HDPE, PE, Pebax™, Hyrtel™, TPE, Nylon, ABS, PP, PVC, Aluminum, Magnesium, and Epoxy.

In an embodiment, the toe cap 18 may be made from a material that is harder than that of the toe cap extension 20. The toe cap 18 may be made from a first material that has a first material hardness value, and the toe cap extension 20 may be made from a second material having a second material hardness value that is less than the first hardness value. The first material of the toe cap 18 may be different from the second material of the toe cap extension 20. The second material of the toe cap extension 20 may be hard enough to offer abrasion protection. Such hard materials may be difficult to thermo-deform under normal circumstances, but the properties and features of the toe cap extension 20 described herein make it easier to thermally deform the toe cap extension 20.

The ability of the toe cap extension 20 to allow for a free or freer movement of the skate boot 12 rearward of the forward-most eyelet 42A may be achieved by one or both of the geometry of the toe cap extension 20 (e.g. its shape, thickness $T_{EXT}$, configuration, etc.) and the material selection of the toe cap extension 20. In an embodiment, the material of the toe cap extension 20 is more resistant to abrasion than the material of the side portion 16C of the skate boot 12. This can be accomplished by using the same material for both the toe cap extension 20 and the toe cap 18, in which case the toe cap extension 20 may have a thinner geometry than that of the toe cap 18 to compensate for the rigidity of such material. This can alternatively be accomplished by using a softer or more malleable material for the toe cap extension 20, in which case the geometry of the toe cap extension 20 may be similar to that of the toe cap 18.

Referring to FIGS. 3A and 3B, part of the material of the toe cap extension 20 overlaps and is combined with the material of the toe cap 18. For example, in FIGS. 3A and 3B, the material of the thickness transition region 18F includes an inner base of the toe cap 18 material overlaid with an outer layer of the material of the toe cap extension 20. Similarly, in FIGS. 3A and 3B, the flap 18E of the toe cap 18 include an inner portion made from the material of the toe cap 18 and an outer surface or layer of the flap 18E made from the material of the toe cap extension 20.

Referring to FIGS. 1D and 3A, the toe cap extension 20 includes an upper portion 24 that extends along a top portion of the skate boot 12 and overlaps a portion of the tongue 40 secured between the side portions 16C of the skate boot 12. The upper portion 24 is spaced apart from the remainder of the toe cap extension 20 extending rearwardly from the toe cap side portions 18C. The aft edge 22B runs along the upper portion 24 of the toe cap extension 20. A fourth segment 22B4 of the aft edge 22B defines the rearmost edge of the upper portion 24 of the toe cap extension 20. The boundary BL between the toe cap 18 and the upper portion 24 of the toe cap extension 20 is defined along the coterminous forward edge 22A of the upper portion 24 of the toe cap extension 20 and a rear edge 18RE of the upper portion 18A of the toe cap 18. The boundary BL along the upper portion 24 is forward of the forward-most eyelet 42A (see FIG. 1D). The material and configuration of the upper portion 24 of the toe cap extension 20 may be the same or different to that of the remainder of the toe cap extension 20. The upper portion 24 has holes 13A for the rivets 13 or other fasteners.

Figure 4B:
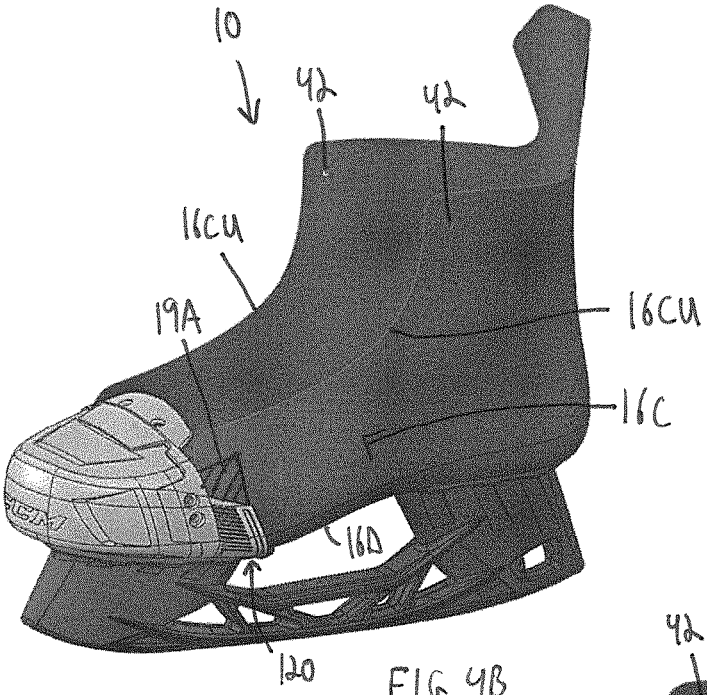
FIG. 4B is a schematic tridimensional view of the skate of FIG. 4A shown without the eyelet protector.
Figure 4A:
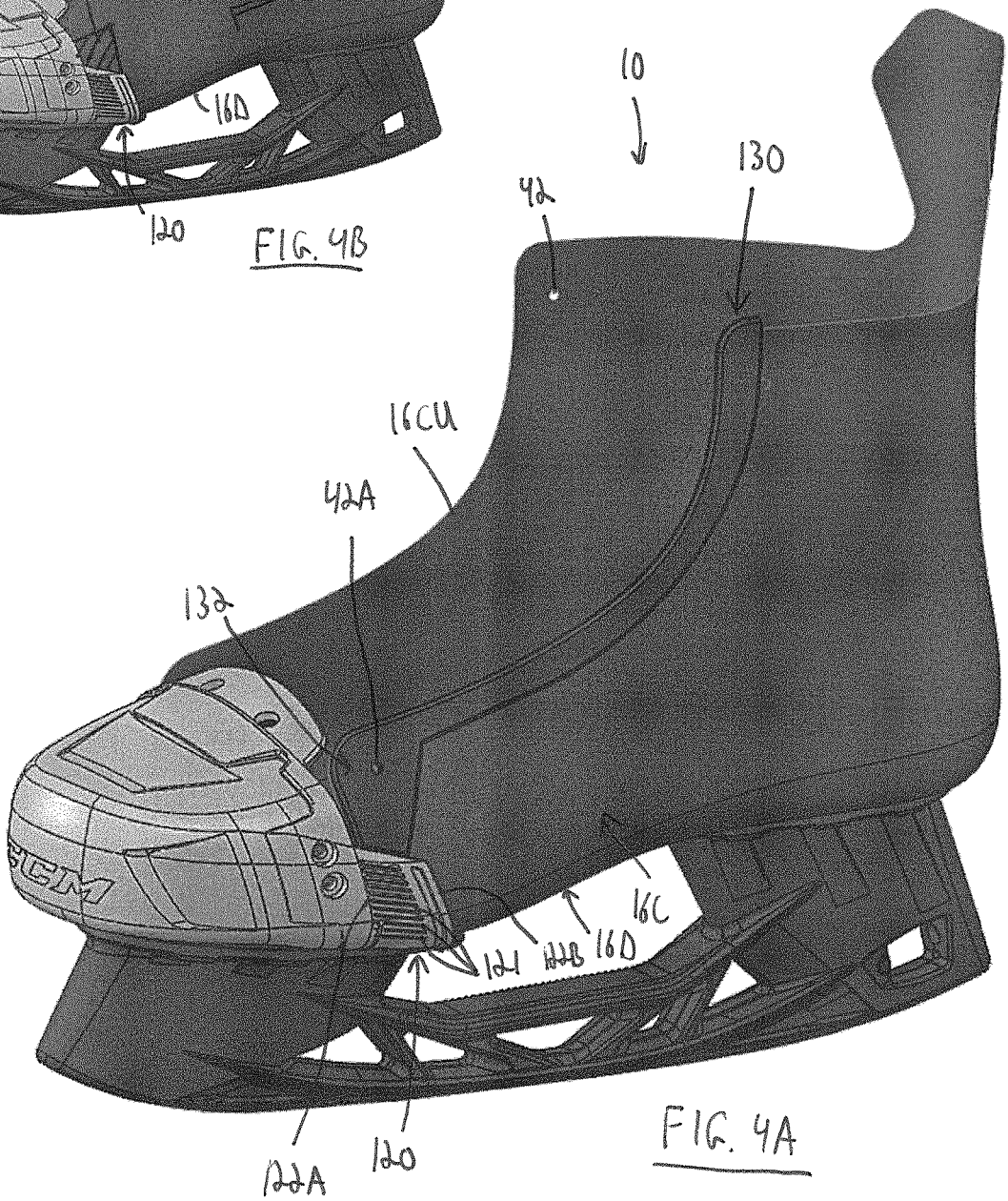
FIG. 4A is a schematic tridimensional view of a skate with a toe cap extension and an eyelet protector.

FIGS. 4A and 4B show the skate 10 with another embodiment of the toe cap extension 120 and an eyelet protector 130. The description of the skate 10 and its features, as well as the reference numbers provided above apply mutatis mutandis to the skate 10 and its features shown in FIGS. 4A and 4B. Similarly, the description of the toe cap extension 20 and its features, as well as the reference numbers provided above apply mutatis mutandis to the toe cap extension 120 and its features shown in FIGS. 4A and 4B. The toe cap extension 120 in FIGS. 4A and 4B has grooves and corresponding protrusions 121 that extend in a longitudinal direction that is parallel to the longitudinal axis 11 of the skate 10. The toe cap extension 120 covers some of the overlapped portion 19A adjacent to the sole portion 16D of the boot shell 16 and the area of the side portion 16C immediately upward therefrom. The aft edge 122B of the toe cap extension 120 is aft of the forward-most eyelet 42A, and the forward edge 122A is forward of the forward-most eyelet 42A.

The eyelet protector 130 surrounds the eyelets 42 and covers the surface of the side portions 16C in the vicinity of the eyelets 42 in order to protect these surfaces and the eyelets 42 from damage. In FIG. 4A, the eyelet protector 130 runs along most of the length of an upper edge 16CU of one or more of the side portions 16C, and extends downwardly from the upper edge 16CU to cover an area of the side portion 16C immediately beneath the upper edge 16CU. In the vicinity of the forward-most eyelet 42A, the eyelet protector 130 has a lower portion 132 which is oriented substantially vertically and which covers a greater surface area of the side portion 16C than the segment of the eyelet protector 130 along the upper edge 16CU. Referring to FIG. 4A, the lower portion 132 extends over the remainder of the overlapped area 19A that is not already covered by the toe cap extension 120 to meet up with, and abut, an upper edge of the toe cap extension 120. The eyelet protector 130 may be made from any suitably hard material to protect the surfaces it overlies, such as for example TPU.

Figure 5:
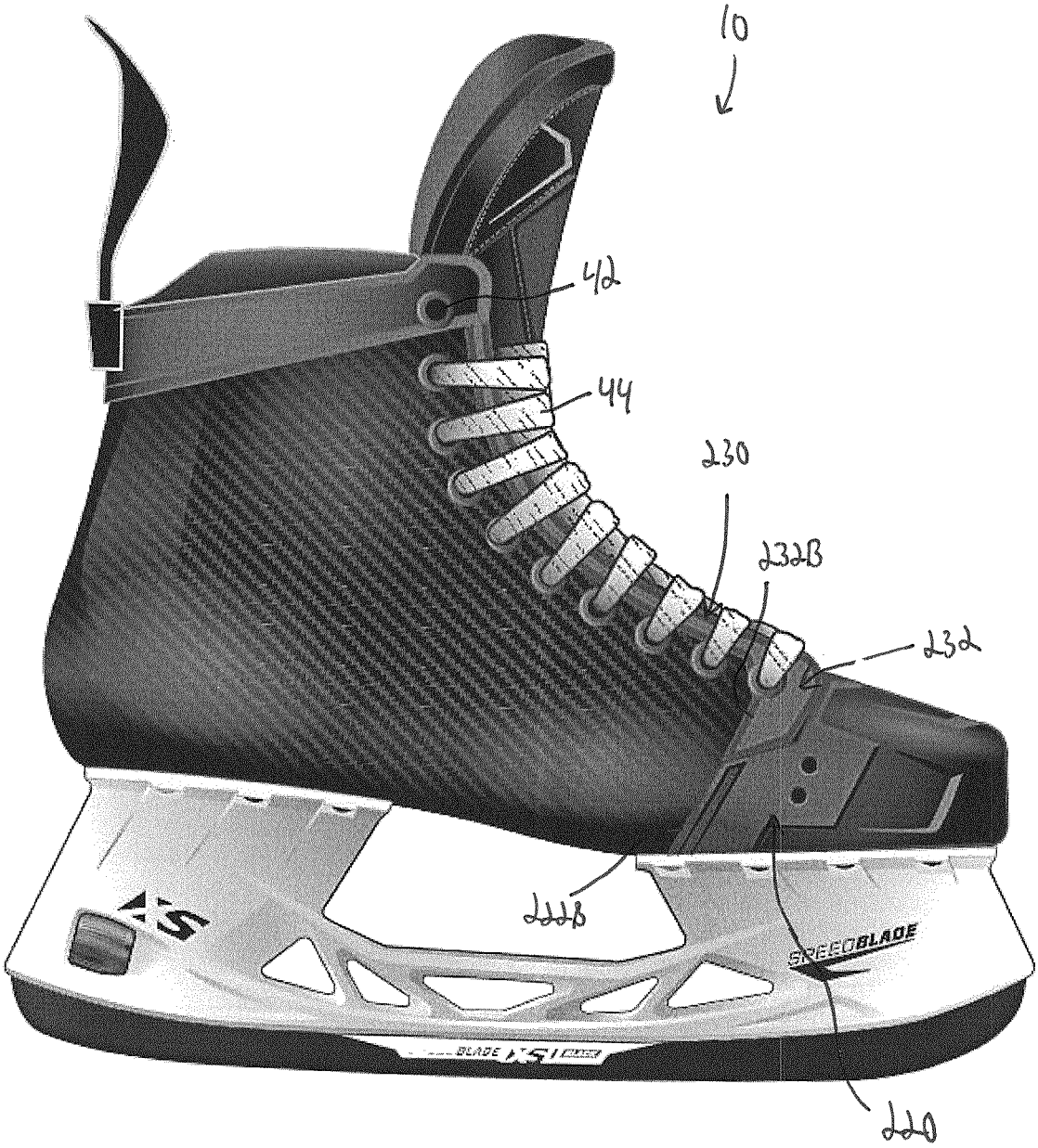
FIG. 5 is a schematic tridimensional view of another skate with a toe cap extension and an eyelet protector.
Figure 6A:
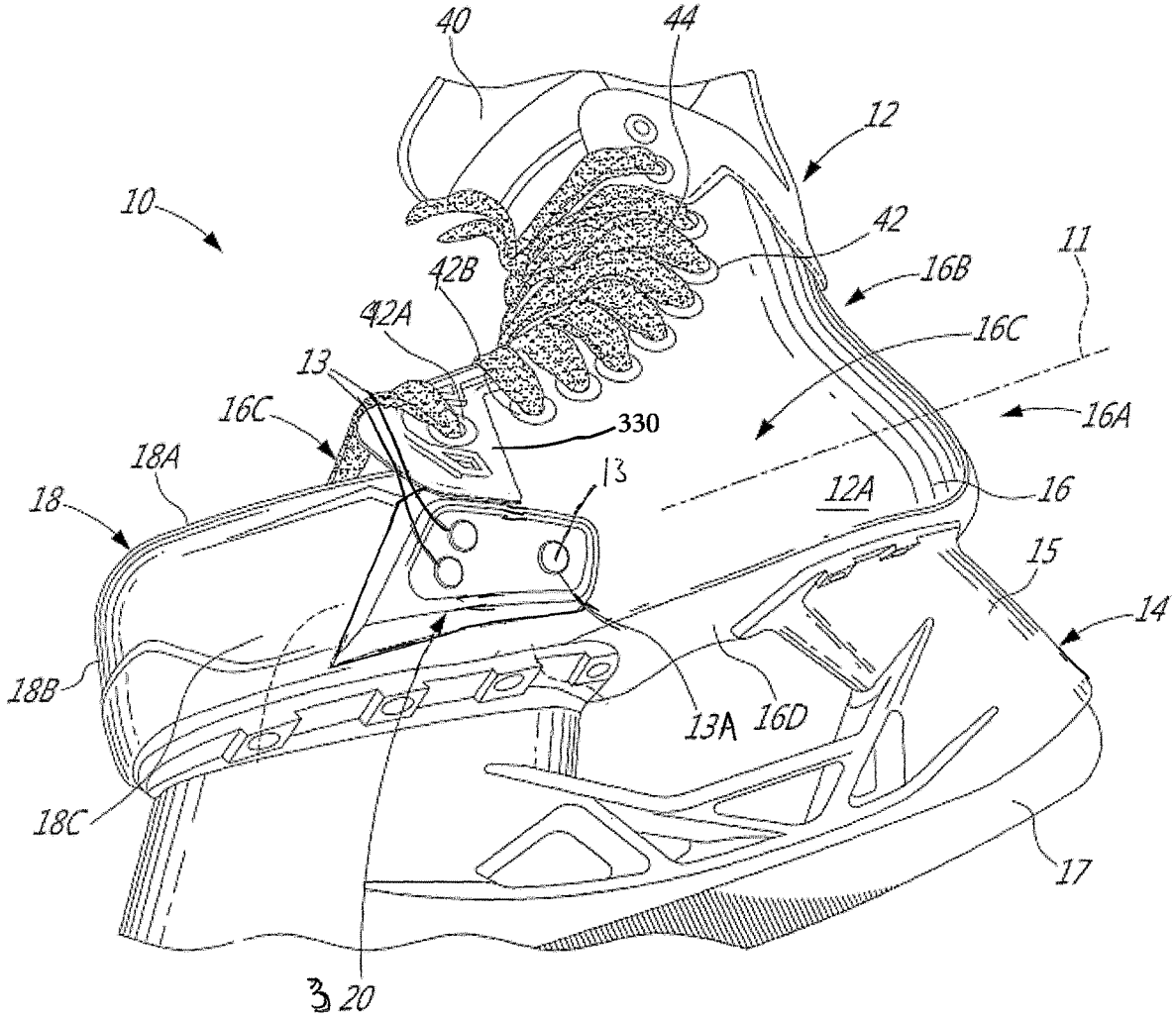
FIG. 6A is a schematic tridimensional view of a skate with another toe cap extension.
Figure 6B:
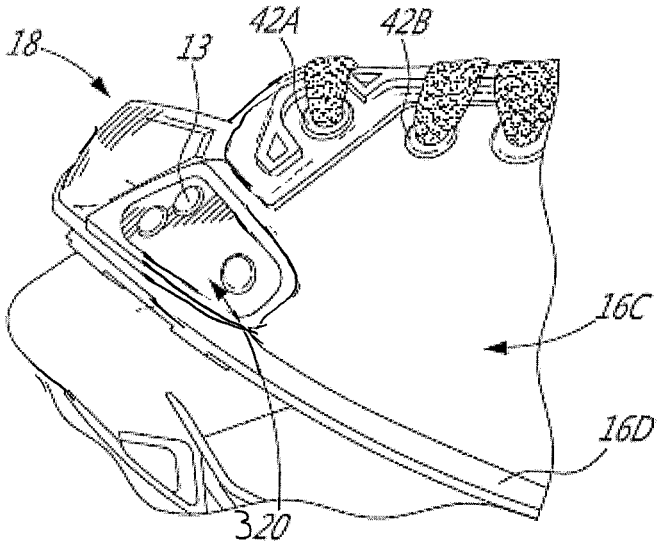
FIG. 6B is an enlarged view of a toe cap and the toe cap extension of the skate of FIG. 6A.
Figure 6C:
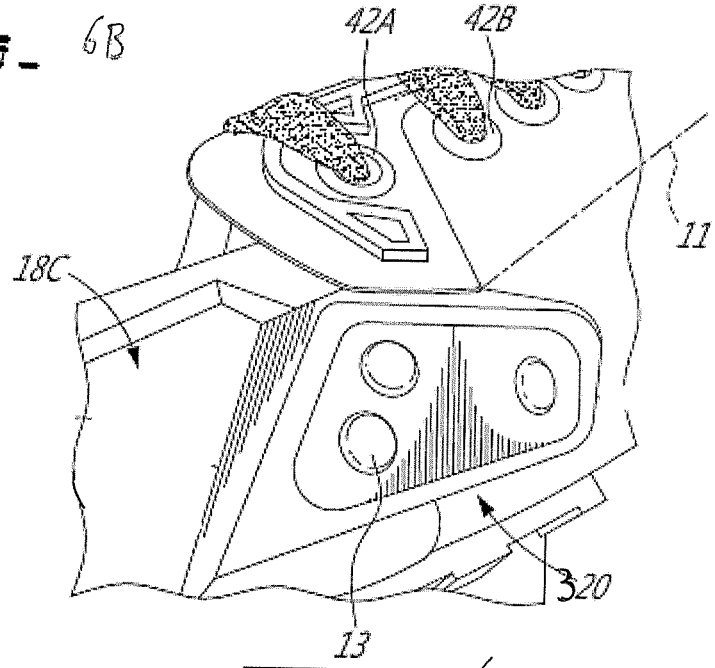
FIG. 6C is another enlarged view of the toe cap and the toe cap extension of the skate of FIG. 6A.
Figure 6D:
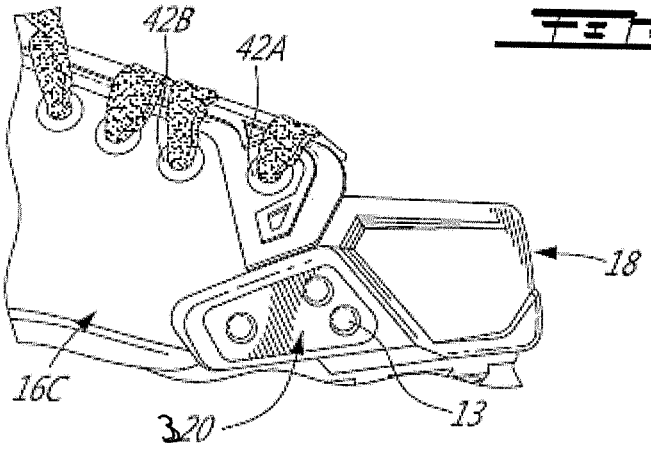
FIG. 6D is another enlarged view of the skate of FIG. 6A, showing the toe cap and the toe cap extension from another side of the skate.

FIG. 5 shows the skate 10 with another embodiment of the toe cap extension 220 and the eyelet protector 230. The description of the skate 10 and its features, as well as the reference numbers provided above apply mutatis mutandis to the skate and its features shown in FIG. 5. Similarly, the description of the toe cap extension 20,120 and its features, as well as the reference numbers provided above apply mutatis mutandis to the toe cap extension 220 and its features shown in FIG. 5. Similarly, the description of the eyelet protector 130 and its features, as well as the reference numbers provided above apply mutatis mutandis to the eyelet protector 230 and its features shown in FIG. 5. In FIG. 5, the lower portion 232 of the eyelet protector 230 extends over some of the overlapped area 19A to meet up with, and abut, an upper edge of the toe cap extension 220. The aft edge 222B of the toe cap extension 220 is parallel to an aft edge 232B of the lower portion 232. The aft edge 222B of the toe cap extension 220 is aligned with the aft edge 232B of the lower portion 232. The aft edge 222B of the toe cap extension 220 is collinear with the aft edge 232B of the lower portion 232. In an alternate embodiment, an example of which is shown in FIG. 1C, the eyelet protector 30 is part of the toe cap extension and extends upwardly from along the side portion 16C over some of the overlapped area 19A, and to surround one or more of the eyelets 42 and cover the surface of the side portions 16C in the vicinity of the eyelets 42.

FIGS. 6A to 6D show the skate 10 with another embodiment of the toe cap extension 320. The description of the skate 10 and its features, as well as the reference numbers provided above apply mutatis mutandis to the skate 10 and its features shown in FIGS. 6A to 6D. Similarly, the description of the toe cap extension and its features, as well as the reference numbers provided above apply mutatis mutandis to the toe cap extension 320 and its features shown in FIGS. 6A to 6D. Similarly, the description of the eyelet protector 30,130 and its features, as well as the reference numbers provided above apply mutatis mutandis to the eyelet protector 330 and its features shown in FIGS. 6A to 6D. The toe cap extension 320 is positioned to cover the area prone to abrasion 19 of the side portion 16C of the skate boot 12. The toe cap extension 320 is positioned over the side portion 16C and beneath the forward-most eyelet 42A. The toe cap extension 320 is positioned between the eyelet 42A and the sole portion 16D of the skate boot 12. The axial extent of the toe cap extension 320 along the longitudinal axis 11 is from the toe cap side portion 18C to an axial position between the forward-most eyelet 42A and the second eyelet 42B immediately adjacent the forward-most eyelet 42A. The toe cap extension 320 extends rearwardly of the forward-most eyelet 42A. The toe cap extension 320 has a hole 13A for receiving the rivet 13 or other fastener to join the toe cap extension 320 to the side portion 16C.

Figure 7A:
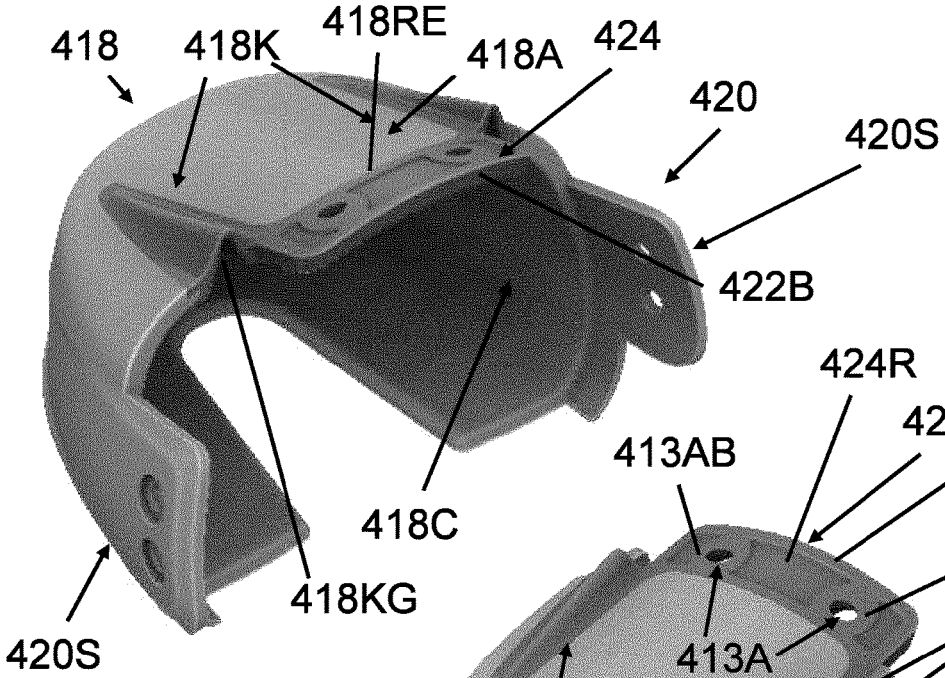
FIG. 7A is a schematic tridimensional view of another toe cap and toe cap extension of the skate of FIG. 1A.
Figure 7B:
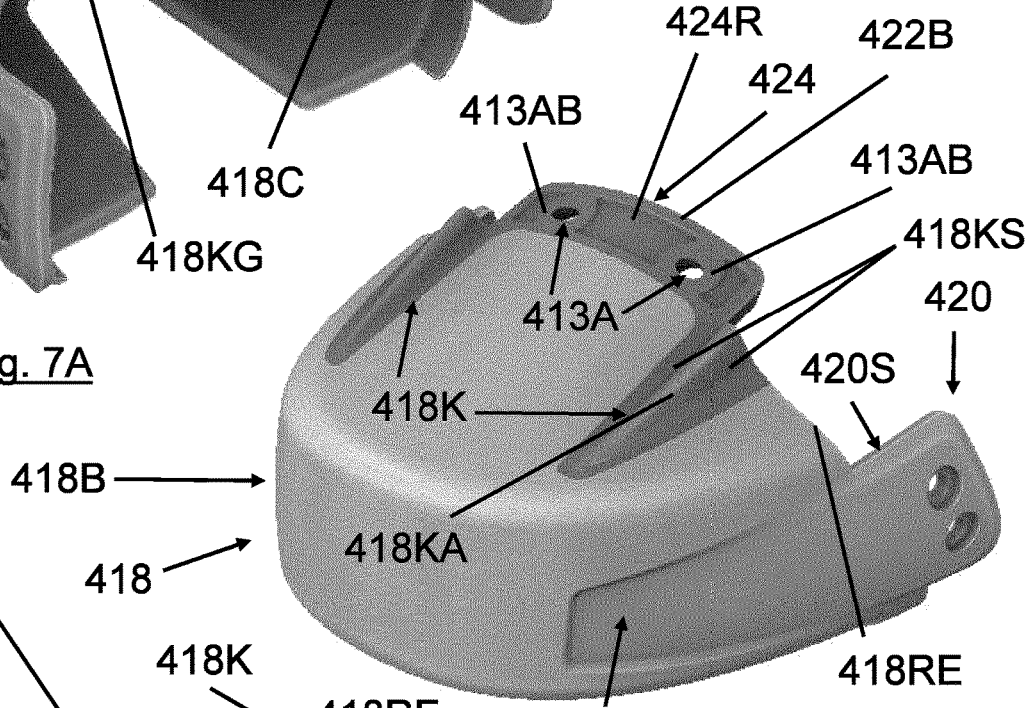
FIG. 7B is another schematic tridimensional view of the toe cap and toe cap extension of FIG. 7A.
Figure 7C:
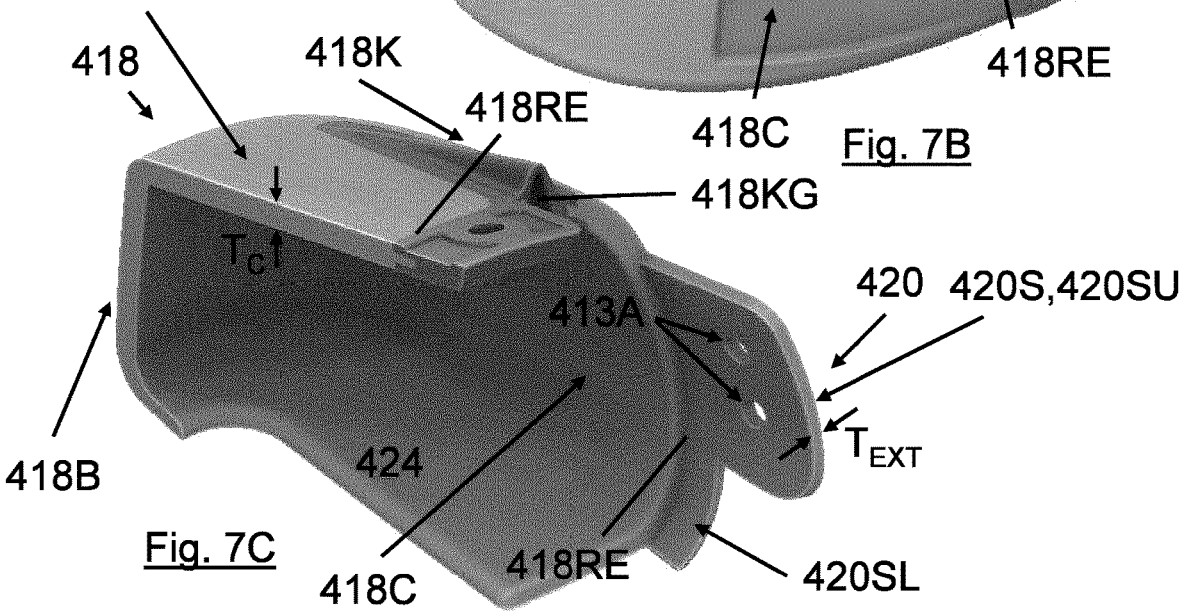
FIG. 7C is a cross-sectional view of the toe cap and toe cap extension of FIG. 7A.

FIGS. 7A to 7C show another embodiment of the toe cap 418 and the toe cap extension 420. The description of the toe cap 18 and its features, as well as the reference numbers provided above apply mutatis mutandis to the toe cap 418 and its features shown in FIGS. 7A to 7C. Similarly, the description of the toe cap extension 20,120,220,320 and its features, as well as the reference numbers provided above apply mutatis mutandis to the toe cap extension 420 and its features shown in FIGS. 7A to 7C. The toe cap 418 includes two kinked portions 418K positioned between, and connecting, the upper portion 418A to the toe cap side portions 418C. Each of the kinked portions 418K include angled segments 418KS which extend upwardly to meet at an apex 418KA of the kinked portion 418K. The angled segments 418KS define a gap 418KG therebetween. A length of each kinked portion 418K, which is measured along the angled segments 418KS, is longer than a width of the same kinked portion 418K. This structure of the kinked portion 418K allows for improved movement of the upper portion 418A of the toe cap 418 relative to the toe cap side portions 418C during forming or use of the skate boot 12.

Referring to FIGS. 7A to 7C, the toe cap extension 420 includes an upper portion 424 that extends along a top portion of the skate boot 12 and overlaps a portion of the tongue 40 secured between the side portions 16C of the skate boot 12. The upper portion 424 is spaced apart from the remainder of the toe cap extension 420 extending rearwardly from the toe cap side portions 418C. The aft edge 422B of the toe cap extension 420 runs along the upper portion 424. The upper portion 424 includes holes 413A for rivets 13. The holes 413A are defined or bordered by bordering portions 413AB which are raised from a recessed surface 424R of the remainder of the upper portion 424. From the front end portion 418B to the rear edge 418RE of the toe cap 418, the thickness $T_C$ is substantially constant. The thickness $T_{EXT}$ of the toe cap extension 420 along its side portions 420S is less than the thickness $T_C$ of the toe cap 418. The toe cap extension 420 is present over the side portions 16C and the top portion of the skate boot 12, and is not present over the sole portion 16D of the skate boot 12. The toe cap extension 420 includes side portions 420S which extend rearwardly from the rear edge 418RE of the toe cap 418 to cover the side portions 16C of the skate boot 12. Each of the side portions 420S has holes 413A, which allow the side portions 420S to be fastened to the side portions 16C of the skate boot 12. Each of the side portions 420S includes an upper segment 420SU and a lower segment 420SL positioned below the upper segment 420SU. The aft edge 422B of the toe cap extension 420 along the upper segment 420SU is positioned rearwardly of the aft edge 422B along the lower segment 420SL.

Referring to FIGS. 7A to 7C, part of the material of the toe cap extension 420 overlaps and is combined with the material of the toe cap 418. For example, referring to FIG. 7C, the material of the upper portion 424 includes an inner protrusion of the toe cap 418 material overlaid with an outer layer of the material of the toe cap extension 420. Referring to FIGS. 7A and 7C, each of the kinked portions 418K of the toe cap 418 may be made from the same material as the upper portion 424 of the toe cap extension 420, and may be made from a material different than the material of the toe cap 418.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A skate, comprising:

a skate boot comprising a heel portion, an ankle portion connected to the heel portion, and two opposed boot side portions extending from the heel and ankle portions to a forward edge of the boot side portions, eyelets defined in each of the boot side portions, a forward-most eyelet being the eyelet closest to the forward edge of the boot side portions;

a toe cap connected to the skate boot at a front end thereof, the toe cap having an upper portion, a front portion, and toe cap side portions extending rearwardly to a rear edge of the toe cap, the rear edge of the toe cap being disposed forward of the forward-most eyelet;

a toe cap extension extending rearwardly from the rear edge of the toe cap and over a portion of at least one of the boot side portions defined rearward of the forward edge and below the forward-most eyelet, the toe cap extension covering an outer side of the portion of the at least one of the boot side portions, the toe cap extension engaging the portion and configured for allowing movement of at least the skate boot rearward of the forward-most eyelet during formation of the skate boot or use thereof; and a holder mounted under the skate boot and configured for retaining a ground-engaging skate element.

2. The skate of claim 1, wherein the toe cap extension has a thickness less than a thickness of the toe cap to allow movement of at least the skate boot rearward of the forward-most eyelet during formation of the skate boot or use thereof.

3. The skate of claim 1, wherein the toe cap extension is made of material that is more malleable than a material of the toe cap, to allow movement of at least the skate boot rearward of the forward-most eyelet during formation of the skate boot or use thereof.

4. The skate of claim 1, wherein the toe cap extension has a thickness less than a thickness of the toe cap and the toe cap extension is made of material that is more malleable than a material of the toe cap, to allow movement of at least the skate boot rearward of the forward-most eyelet during formation of the skate boot or use thereof.

5. The skate of claim 1, wherein the portion of the at least one boot side portion extends upwardly from a sole portion the skate boot to immediately beneath the forward-most eyelet, the toe cap extension extending upwards to cover the portion.

6. The skate of claim 1, comprising an eyelet protector over at least one of the boot side portions and disposed around the forward-most eyelet, the eyelet protector extending downwardly over at least some of the portion of the at least one boot side portion.

7. The skate of claim 1, wherein the toe cap extension has an upper portion extending rearwardly from the rear edge of the toe cap along a top portion of the skate boot to overlie a foot of the wearer or a tongue of the skate.

8. The skate of claim 1, wherein the toe cap extension has an aft edge defined by a first segment of the aft edge extending upwardly from a sole portion of the skate boot toward the forward-most eyelet, a second segment extending from the first segment in a substantially forward direction toward the front portion of the toe cap, and a third segment extending from the second segment in an upward direction toward the upper portion of the toe cap, the first segment disposed rearward of the forward-most eyelet.

9. The skate of claim 8, wherein the third segment is disposed in front of the forward-most eyelet.

10. The skate of claim 1, wherein a thickness of the toe cap extension is constant.

11. The skate of claim 1, wherein a thickness of the toe cap varies between the front portion and the rear edge.

12. The skate of claim 1, wherein the toe cap has a thickness transition region adjacent to the rear edge, a thickness of the thickness transition region being equal to a thickness of the toe cap at a forward end of the thickness transition region, and the thickness of the thickness transition region being equal to a thickness of the toe cap extension at a rear end of the thickness transition region.

13. The skate of claim 1, wherein the toe cap is made from a first material and the toe cap extension is made of a second material different from the first material, the toe cap adjacent to the rear edge thereof having an inner portion made of the first material and an outer portion made of the second material and overlying the inner portion.

14. The skate of claim 1, wherein a forward-most edge of the toe cap extension is coterminous with the rear edge of the toe cap and defines a boundary, the boundary disposed in front of the forward-most eyelet.

15. The skate of claim 1, wherein a part of the forward edge of the boot side portion is aft of the rear edge of the toe cap.

16. The skate of claim 1, wherein the toe cap is made from a first material having a first hardness, and the toe cap extension is made from a second material having a second hardness being less than the first hardness.

17. The skate of claim 1, wherein the toe cap extension is integral with the toe cap.

18. The skate of claim 1, wherein the toe cap extension is separate from the toe cap and secured to one or both of the toe cap and the boot side portion.

19. The skate of claim 1, wherein the toe cap extension is a first toe cap extension extending rearwardly from the rear edge of the toe cap and over the portion of one of the boot side portions, the skate comprising a second toe cap extension extending rearwardly from the rear edge of the toe cap and over the portion of the other boot side portion.

20. The skate of claim 1, wherein the toe cap extension has an axial extent along a longitudinal axis of the skate from the rear edge of the toe cap to an axial position aft of the forward-most eyelet and between another eyelet adjacent the forward-most eyelet.

* * * * *